US005601427A

United States Patent [19]

Yuasa et al.

[11] Patent Number: 5,601,427

[45] Date of Patent: Feb. 11, 1997

[54] WASTE MELTING FURNACE AND A METHOD OF MELTING WASTES

[75] Inventors: Tatsuo Yuasa, Kakamigahara; Tetsuhisa Sugiura, Kani, both of Japan

[73] Assignee: Daidotokushuko Kabushikikaisha, Japan

[21] Appl. No.: 506,051

[22] Filed: Jul. 24, 1995

[30] Foreign Application Priority Data

| | | | |
|---|---|---|---|
| Jul. 25, 1994 | [JP] | Japan | 6-193595 |
| Jul. 25, 1994 | [JP] | Japan | 6-193596 |
| Jul. 26, 1994 | [JP] | Japan | 6-193545 |
| Jul. 27, 1994 | [JP] | Japan | 6-195924 |

[51] Int. Cl.[6] ..... F27D 15/02; F27D 1/00; F27D 1/02

[52] U.S. Cl. ..... 432/77; 432/85; 432/161; 432/233

[58] Field of Search ..... 110/235; 432/4, 432/85, 103, 104, 105, 115, 248, 252, 161

[56] References Cited

U.S. PATENT DOCUMENTS

| | | | |
|---|---|---|---|
| 3,752,638 | 8/1973 | Van Laar et al. | 432/4 |
| 3,785,764 | 1/1974 | Delacroix et al. | 432/85 |
| 4,212,630 | 7/1980 | Vorobeichikov et al. | 432/116 |
| 4,781,581 | 11/1988 | Bleickert et al. | 432/161 |
| 4,973,245 | 11/1990 | Monni | 432/77 |
| 5,350,296 | 9/1994 | Wikstrom | 432/233 |

FOREIGN PATENT DOCUMENTS

| | | |
|---|---|---|
| 51-116103 | 10/1976 | Japan . |
| 682028A | 3/1994 | Japan . |

*Primary Examiner*—Weilun Lo
*Attorney, Agent, or Firm*—William A. Drucker

[57] ABSTRACT

A furnace body is partly or thoroughly made of a metal material. An inner peripheral face of the metal material portion is covered by a lining. Spray means for cooling the lining of a relatively thin portion via the metal material portion of the furnace body is disposed outside the furnace body. When wastes are to be melted, wastes are melted under a state where the spray means sprays coolant on the outer face of the furnace body and cools the lining, thereby preventing erosion of the lining from occurring.

8 Claims, 5 Drawing Sheets

WASTE MELTING FURNACE AND A METHOD OF MELTING WASTES

BACKGROUND OF THE INVENTION

1. Field of the Invention

The invention relates to a waste melting furnace which melts wastes of various kinds to reduce their volume, and also to a method of melting wastes by using the melting furnace.

2. Description of the Prior Art

A furnace body is composed of a furnace bottom for receiving melts, a furnace side for surrounding melts placed on the furnace bottom and the side peripheral of the space above the melts, and a furnace roof for closing the top of the space. In each of the furnace bottom, the furnace side, and the furnace roof, the inner face of a shell is covered by a thick lining for protecting the shell. A waste inlet and a gas outlet are formed in the furnace roof, a melt outlet is formed in the furnace side, and heating means for heating wastes is disposed in the furnace body (for example, see Japanese Patent Publication (Kokai tokkyo koho 6-82028).

In such a waste melting furnace, wastes charged through the waste inlet are heated by the heating means and melted so that the volume of the wastes is largely reduced. The lining for protecting the shell from corrosive gasses produced from melting wastes has a large thickness. Even when the lining is gradually eroded as a result of a long-term operation, therefore, the protection effect can still be maintained, thereby presenting a feature that the furnace can be operated continuously in a long term.

In the prior art waste melting furnace, the large thickness of the lining produces various problems as discussed below. In the furnace roof, for example, the weight is increased so that the support structure must have a high strength, and the roof has a large thickness so that the height of the furnace is large as compared with the capacity of the furnace. It may be contemplated that the furnace roof is provided with a water jacket so as to reduce the thickness of the roof. However, such a configuration is not employed because there is a danger that, when the water Jacket is broken, a large amount of water drops into the furnace to cause an explosion accident.

In the furnace side, since the thick lining is used as described above, the thickness is large. This produces a problem in that the diameter of the furnace is large as compared with the capacity of the furnace, resulting in a large installation area.

In the furnace bottom, the thick lining causes the furnace bottom to be thickened, thereby producing a problem in that the furnace is tall as compared with the capacity of the furnace. Wastes contain a large amount of heavy metals such as copper, lead, and zinc, and such heavy metals melt into a base metal in the furnace. Since such metals have a low melting point, molten heavy metals penetrate into joints and cracks of the lining of the furnace bottom, to reach the lower portion of the furnace bottom. The difference in coefficient of thermal expansion between the metals and the lining causes a problem in that the lining is damaged and the shell is melted away to cause an accident that the melts downward leak out through the furnace bottom. The leakage produces another problem in that the environment may be polluted.

In such a waste melting furnace, furthermore, the furnace roof is provided with many attachments such as the waste inlet, the gas outlet, a temperature measurement hole, and a sampling hole, and also with various parts associated with these attachments. These components must be inspected and operated in various manners. During the operation of the furnace, moreover, the upper face of the furnace roof is at a very high temperature of, for example, about 200° C. This produces a further problem in that works of inspection or operation entail dangers and therefore are difficult to perform.

SUMMARY OF THE INVENTION

It is an object of the invention to provide a waste melting furnace which can melt wastes to reduce their volume.

It is another object of the invention to provide a waste melting furnace in which the furnace body can be protected from melts of the wastes and the gasses for a long period by a lining formed on the inner face of the furnace body, thereby enabling the furnace to be used for a long term.

It is a further object of the invention to reduce the thickness of a lining for the protection of the furnace roof without impairing the protection effect for a long term, whereby the thickness of the furnace roof is reduced to lighten the weight of the furnace roof and the height of the furnace is reduced.

It is a still further object of the invention to provide a configuration in which, even when the furnace roof is broken, the danger due to the breakage can be suppressed to a low level.

It is a still further object of the invention to provide a waste melting furnace in which the thickness of a lining for the protection of the furnace side plate can be reduced without impairing the protection effect for a long term, whereby the diameter of the furnace can be reduced as compared with the capacity of the furnace.

It is a still further object of the invention to reduce the thickness of a lining for the protection of the furnace bottom without impairing the protection effect for a long term, whereby the thickness of the furnace bottom is reduced and the height of the furnace is reduced.

It is a still further object of the invention to provide a configuration in which, even when heavy metals of melts penetrate into Joints and cracks of the lining of the furnace bottom, the molten heavy metals are prevented from downward leaking from the furnace bottom, whereby the environment is prevented from being polluted by the heavy metals.

It is a still further object of the invention to enable the effect of the protection of the furnace roof, the furnace side plate, the furnace bottom plate, etc. due to the thinned lining, to be maintained at a low running cost.

It is a still further object of the invention to provide a configuration in which, in place of a water jacket, a spray system is employed as cooling means for maintaining the effect of the protection of the furnace roof, the furnace side plate, the furnace bottom plate, etc. due to the thinned lining, so that the water pressure of a water jacket or the like is not applied to the furnace roof, the furnace side plate, the furnace bottom plate, etc., whereby, even when the furnace roof, the furnace side plate, the furnace bottom plate, or the like is damaged, the leakage amount of water can be suppressed to a minimal level and the danger of explosion due to water leakage can be lessen.

It is a still further object of the invention to provide a waste melting furnace in which the temperature of a work board disposed above the furnace roof can be kept to be low so that works to be performed on the work board, i.e., inspection works and operation of various members disposed on the furnace roof are safely performed.

Other objects and advantages will readily appear from the accompanying drawings and the following description with reference to the drawings.

Configurations and method according to the first to the seventh invention of the present application are as follows;

[First] A waste melting furnace comprising a furnace body which surrounds melts, wastes to be placed on the melts, and a space above the melts and the wastes, a waste inlet, a melt outlet, and a gas outlet being disposed in said furnace body, heating means for heating the wastes being disposed in said furnace body so that wastes charged through said waste inlet are heated by the heating means and melted, wherein at least a portion of said furnace body is made of a metal material, an inner peripheral face of said metal material portion is covered by a lining for protecting said furnace body, said lining having a relatively small thickness which allows an erosion protection effect due to cooling which is conducted from a side of an outer face, to reach a side of an inner face, and spray means for spraying coolant on an outer peripheral face of said furnace body in order to cool said lining of said relatively thin portion, via said metal material portion is disposed outside said furnace body.

[Second] A waste melting furnace according to the first invention, wherein said portion of said furnace body is a roof of said furnace body, said roof is composed of a roof plate made of a metal, and a lining covering a lower face of said roof plate, said lining has a relatively small thickness which allows an erosion protection effect due to cooling which is conducted from a side of an upper face, to reach a side of a lower face, and spray means for spraying coolant on an upper face of said roof plate in order to cool said lining via said roof plate is disposed above said roof plate.

[Third] A waste melting furnace according to the first invention, wherein said portion of said furnace body is a side plate of said furnace body, said side plate is composed of a side plate made of a metal, and a lining covering an inner peripheral face of said side plate, said lining has a relatively small thickness which allows an erosion protection effect due to cooling which is conducted from a side of an outer face, to reach a side of an inner face, and spray means for spraying coolant on an outer face of said side plate in order to cool said lining via said side plate is disposed outside said side plate.

[Fourth] A waste melting furnace comprising a furnace body which surrounds melts, wastes to be placed on the melts, and a space above the melts and the wastes, a waste inlet, a melt outlet, and a gas outlet being disposed in said furnace body, heating means for heating the wastes being disposed in said furnace body so that wastes charged through said waste inlet are heated by the heating means and melted, wherein a bottom of said furnace body is composed of a furnace bottom plate made of a metal, and a lining covering an upper face of said furnace bottom plate, said lining has a relatively small thickness which allows an erosion protection effect due to cooling which is conducted from a side of a lower face, to reach a side of an upper face, and spray means for spraying coolant on a lower face of said furnace bottom plate in order to cool said lining via said furnace bottom plate so that a middle portion of said lining in a thickness direction has a temperature lower than a solidification temperature of the melts on said lining is disposed below said furnace bottom plate.

[Fifth] A method of melting wastes wherein wastes are heated and melted in a furnace body which is made of a metal plate, an inner face of said furnace body being covered by a lining, the wastes are melted under a state where said lining is cooled via said furnace body by spraying coolant from spray means on an outer face of said furnace body, thereby preventing erosion of said lining from occurring.

[Sixth] A waste melting furnace comprising a furnace body which surrounds melts, wastes to be placed on the melts, and a space above the melts and the wastes, a waste inlet, a melt outlet, and a gas outlet being disposed in said furnace body, heating means for heating the wastes being disposed in said furnace body so that wastes charged through said waste inlet are heated by the heating means and melted, wherein a work board for a worker is disposed above a roof of said furnace body, said board being separated from said roof by a space for disposing cooling means, and spray means for spraying coolant on an upper face of said furnace roof, thereby cooling said roof and blocking heat radiation from said roof to said work board is disposed in said space for disposing cooling means.

[Seventh] A waste melting furnace comprising a furnace body which surrounds melts, wastes to be placed on the melts, and a space above the melts and the wastes, a waste inlet, a melt outlet, and a gas outlet being disposed in said furnace body, heating means for heating the wastes being disposed in said furnace body so that wastes charged through said waste inlet are heated by the heating means and melted, wherein a roof of said furnace body is composed of a roof plate which is made of a metal and has a slope in order to allow coolant to flow down along an upper face, and a lining covering a lower face of said roof plate, said lining has a relatively small thickness which allows an erosion protection effect due to cooling which is conducted from a side of an upper face, to reach a side of a lower face, and spray means for spraying the coolant on an upper face of a higher portion of said roof plate and allowing the sprayed coolant to flow down to a lower portion along the upper face of said roof plate, thereby cooling a substantially whole area of said lining via said roof plate is disposed above said roof plate.

In this way, the invention can attain effects that, while maintaining the safety of the environment, wastes can continuously be melted to reduce the volume for a long term, and that cooling by spray means can prevent a lining from being eroded so that, even when the lining has a reduced thickness, the lining can be used for a long term, with the result that the furnace can be reduced in outer dimension and weight as compared with the capacity of the furnace.

Since a spray system is employed as the cooling system, furthermore, the water pressure is not applied to the furnace body during a process of water cooling. Even when the furnace body is partly damaged, therefore, the amount of water which leaks into the furnace through the breakage portion can be restricted to a minimal value. This can attain an effect that the danger of explosion due to water leakage can be lessened.

In a furnace shown in FIG. 3, furthermore, a furnace roof 205 can be cooled even when the temperature in the furnace is high during the operation of the furnace, so that the temperature of a work board 222 on the furnace roof 205 is kept to be low. Consequently, there is an effect that the worker on the board can safely perform works. The use of spray means allows the cooling to be conducted with a reduced amount of coolant, thereby producing an effect of a reduced running cost.

DESCRIPTION OF THE PREFERRED EMBODIMENTS

Figure 1:
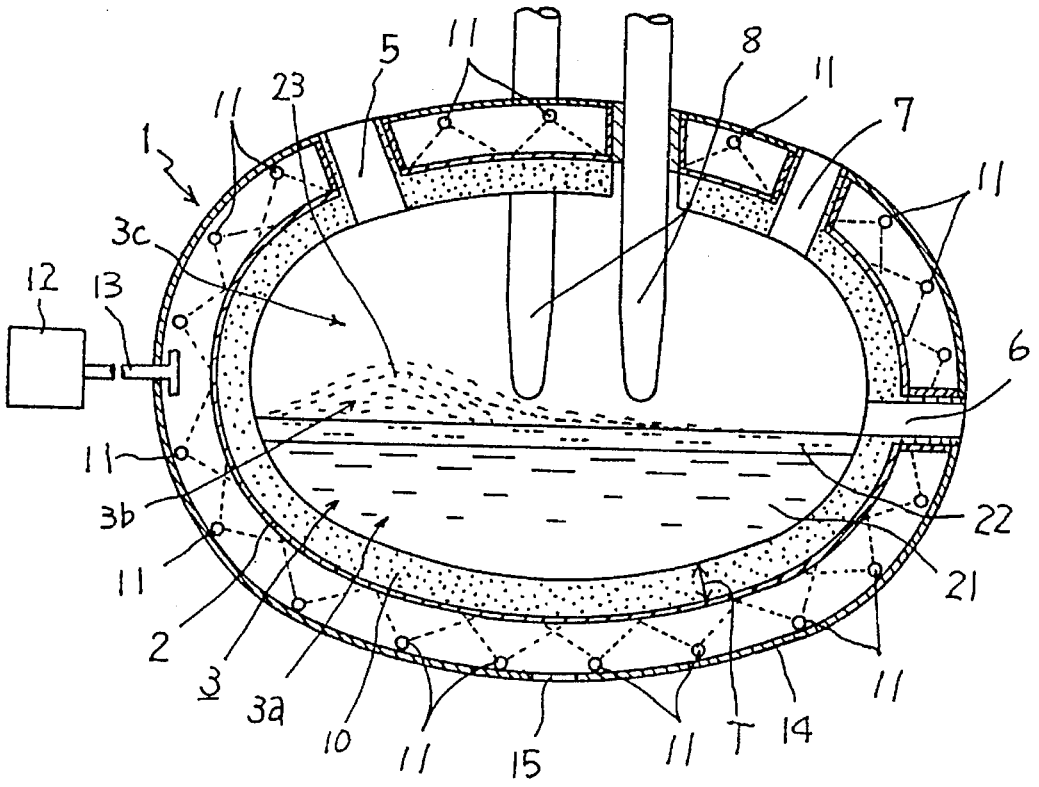
FIG. 1 is a longitudinal section view schematically showing a waste melting furnace.

Hereinafter, the drawings showing embodiments of the invention will be described. In FIG. 1, 1 designates a waste melting furnace, and 2 designates the furnace body which is made of a metal material such as a metal plate, or a steel plate so that the interior space 3 is hermetically closed. The interior space 3 includes: a space 3*a* where melts or a base metal 21, and slug 22 floating thereon are to exist; a space 3*b*, above the space 3*a*, where wastes 23 are to exist; and a space 3*c*, above the space 3*b*, where gasses are to exist. The size of the furnace body 2 is determined in consideration of the thickness of a lining which will be described later, so that a predetermined capacity (the volume of the space 3) is secured when the lining is formed on the inner face. When the thickness of the lining is reduced, therefore, the outer dimension of the furnace body 2 can be reduced in accordance with the reduction in thickness. The reference numeral 5 designates a waste inlet formed in the furnace body 2. Well-known waste charging means which is not shown and can maintain the gastightness of the space 3 is attached to the waste inlet. The reference numerals 6 and 7 designate a melt outlet, and a gas outlet, respectively. Well-known means which are used in the next step and can maintain the gastightness of the space 3, such as an apparatus for granulating melts, and a gas treatment apparatus are connected to these outlets, respectively. The reference numeral 8 designates electrodes for arc heating which function as heating means for melting wastes. Alternatively, as the heating means, electrodes for supplying an electric current to the base metal 21 may be disposed in the space 3*a*, and an electric current is directly supplied from the electrodes to the base metal 21, thereby conducting resistance heating. As the heating means, induction heating means, or combustion heating means using a burner may be used.

The reference numeral 10 designates a lining formed on the whole of the inner peripheral face of the furnace body 2. The lining protects the furnace body 2 from being worn by melts contacting therewith, from being corroded by gasses produced from wastes, and from heat generated when wastes are melted. For example, the following materials may be used as the lining. In a portion contacting with the melts 21 and 22 and the wastes 23, bricks of silicon carbide are used because of high resistance to the melts 21 and 22 and wastes 23. In a portion on the side of the space 3*c*, bricks of magnesia or alumina are used because of high resistance to an oxidizing atmosphere in the space. In a portion corresponding to the upper portion of the space 3*c*, a castable refractory which is high in alumina content is preferably used because of easy application on the portion. The thickness T of the lining 10 is set to be a relatively small value which allows the erosion protection effect due to the cooling which is conducted from the side of the outer face or the side contacting with the furnace body 20 to reach the side of the inner face or the side contacting with the melts and gasses. In other words, the thickness is selected so that the erosion protection effect which will be described later can be attained. For example, the portion for the hearth for supporting the melts in the furnace has a thickness of about 400 to 500 mm, the portion for the furnace side surrounding the sides of the melts and the space above the melts has a thickness of about 250 mm, and the portion for the furnace roof for covering the upper side of the space has a thickness of about 200 mm.

The reference numeral 11 designates the spray means for cooling the lining 10. The spray means sprays coolant on the outer peripheral face of the furnace body 2, thereby cooling the lining 10 via the furnace body 2. In the embodiment, spray nozzles which spray coolant such as chilled water are used. Alternatively, air may be used as coolant. For example, the spray means 11 is disposed so as to spray the coolant on the whole area of the outer peripheral face of the furnace body 2 to cool the whole area. Alternatively, the spray means may spray the coolant on a partial area of the outer peripheral face (a portion of the furnace body 2 which is heated to a high temperature is preferably selected as the area to be sprayed), thereby directly cooling the area, and the other area is cooled by causing the sprayed coolant to flow on the surface of the other area. When air is used as the coolant, a guide plate for air flow may be disposed so that air flow is produced on the other area. In order to reduce the outward projection from the outer peripheral face of the furnace body 2, the spray means 11 is preferably embedded between frame members which are disposed in the side of the outer peripheral face of the furnace body 2 so as to reinforce the body. The reference numeral 12 designates supply means such as a pump for supplying the coolant to the spray means 11, and 13 designates a pipe through which the coolant is supplied. The reference numeral 14 designates an outer cover for preventing the coolant ejected from the spray means from spattering. The coolant ejected from the spray means is allowed to stay between the furnace body 2 and the outer cover 14, so that the chance of contacting the coolant with the furnace body 2 is increased, thereby improving the cooling efficiency. The outer cover 14 keeps dust out the furnace body 2 so that the efficiency of cooling by the spray means 11 is prevented from being impaired. The pipe 13 passes through the outer cover 14. The reference numeral 15 designates a coolant outlet through which the coolant sprayed on the furnace body 2 and flowing down to the lower portion is discharged.

The operation of the waste melting furnace will be described. As well known, the operation of the furnace is started by previously melting a small amount of the base metal 21 in the furnace. After the operation of the furnace is started, wastes such as nonmetal wastes including burned residue of municipal refuse (burned ash), dust collection ash of municipal refuse, plastic wastes, and sewage are charged from the waste inlet 5 into the space 3*b* by the charging means. For example, this charging is continuously conducted. Alternatively, the charging may be intermittently conducted. In the alternative, a small amount of wastes may be charged in each charging operation in order to prevent the gas pressure in the furnace from being largely varied. The charged wastes 23 are heated by heat of arc generated by the electrodes 8, and also by heat transferred from the base metal 21 which is caused to be in a molten state by heat of the arc, and melt to reduce the volume. During the melting operation, the space 3*c* is at a temperature of, for example, about 1,200° C. Most portion of the wastes 23 melts to be converted into the slug 22, and another part is converted into various kinds of gasses. The gasses move up together with dust into the space 3*c*. The gasses and dust which have moved up are discharged through the gas outlet 7 toward the treatment apparatus. The metal components of the molten wastes are sunk by their gravity to enter the base metal 21. As the wastes 23 which are sequentially charged melt so that the amount of the slug 22 is increased, and the slug 22 overflows to be gradually discharged through the outlet 6. The discharged slug is subjected to a solidifying process such as granulation.

During the above-mentioned operation, the coolant is supplied from the supply means 12 to the spray means 11 through the pipe 13, and the coolant is sprayed on the outer peripheral face of the furnace body 2, so that the furnace body 2 is cooled and also the lining 10 is cooled via the furnace body 2, thereby suppressing the erosion of the lining. The sprayed coolant flows down and is then discharged through the outlet 15. As a result of the above-mentioned cooling, the temperature of the outer peripheral face of the furnace body 2 is lowered to, for example, about 200° to 250° C.

During the operation, the furnace body 2 in which the interior space can hermetically be closed prevents the gasses in the furnace from leaking to the outside, and the lining 10 protects the furnace body 2 from being worn by melts contacting therewith, and from being corroded by gasses (for example, corrosive gasses such as chlorine compounds) produced when wastes melt.

Next, the erosion protection effect of the lining 10 due to the above-mentioned cooling will be described. The lining 10 has a relatively small thickness. When the outer face of the lining 10 is cooled by the spray means 11, therefore, the temperature gradient between the outer and inner faces of the lining 10 is steeper than that attained in the case where the lining is formed so as to have a large thickness of, for example, 600 mm in preconsideration of the magnitude of erosion in a predetermined continuous operation period (e.g., one year) of the waste melting furnace. Consequently, the temperature of a position of the lining 10 which is inside from the inner face in the thickness direction by a small distance is very lower than that obtained when in the case where the lining has such a large thickness. Even when the inner face of the lining 10 begins to be melted and corroded by the melts, gasses, and heat, therefore, the degree at which the corrosion and melting proceed in the thickness direction is very low as compared with the above-mentioned case of the large thickness. Consequently, the amount of erosion of the lining 10 is suppressed to a low level. As a result, even when the lining 10 has a relatively small thickness, the erosion protection effect of the lining 10 can be kept to be exhibited on the furnace body 2 over the predetermined continuous operation period of the waste melting furnace.

In order that a predetermined capacity (the volume of the space 3) is secured inside the lining 10 on the inner face, the size of the furnace body 2 is determined in consideration of the thickness of the lining 10. When the thickness of the lining 10 is reduced, therefore, the outer dimension and weight of the furnace body 2 can be reduced in accordance with the reduction in thickness. In an example where the dimension of the whole of the furnace 1 is to be reduced, therefore, the whole portion of the lining 10 is thinned, and the cooling by the spray means 11 is conducted on the whole area of the furnace body 2. In another example where only the outer dimension in a plan view (the diameter in the case where the furnace has a circular shape in a plan view, and the horizontal sizes of the edges in the case where the furnace has a rectangular shape) is to be reduced, only the portion of the lining which corresponds to the side wall of the furnace may be thinned, the portions of the lining which correspond to the bottom and roof of the furnace may be thickened in the same manner as the prior art, and, for example, the furnace bottom may be made of an arbitrary furnace material such as a metal material or another material. The lining may have a thickness of about 600 to 700 mm. In this case, the cooling by the spray means 11 may be conducted at least on the area of the furnace body 2 where the lining is thinned. In another example where only the height of the furnace is to be reduced, contrary to the above-described case, the portions of the lining which correspond to the bottom and roof may be thinned, the cooling by the spray means 11 may be conducted on the areas of the furnace body 2 corresponding to the portions, the other portions of the lining may be thickened, and the cooling on the other areas of the furnace body 2 corresponding to the other portions may be omitted.

In another example, when the melting furnace 1 has an area where the cooling by the spray means 11 is hardly conducted because of various reasons including locational restrictions (e.g., the side faces shown in FIG. 4), lining having an increased thickness may be formed on the area.

Figure 2:
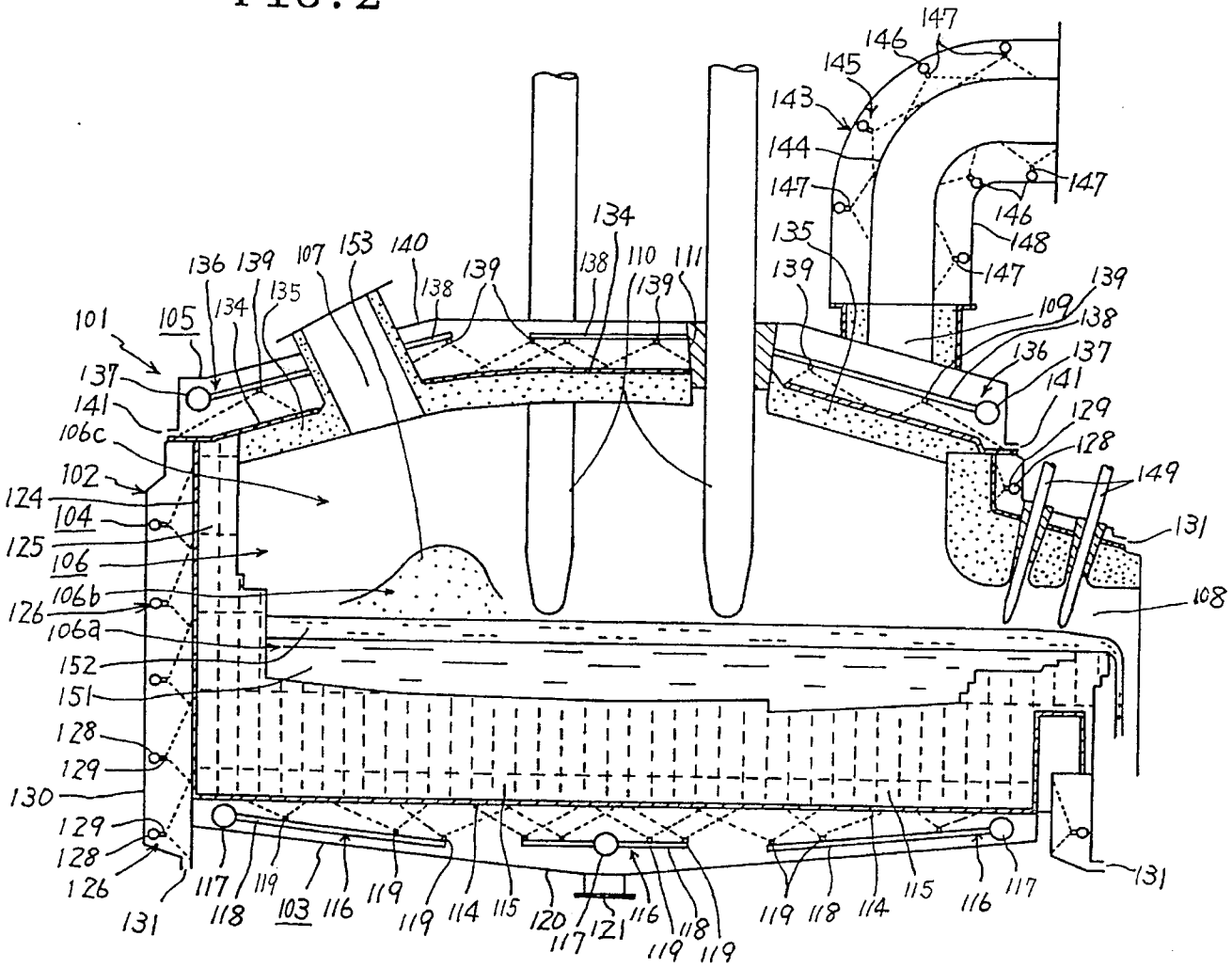
FIG. 2 is a longitudinal section view of another waste melting furnace.

In FIG. 2, 101 designates the body of a waste melting furnace, and 102 designates the furnace main unit of the furnace body 101 which is composed of a furnace bottom 103 for receiving melts 151 and 152, and a furnace side 104 for surrounding the melts placed on the furnace bottom 103 and the side peripheral of spaces 106*b* and 106*c* above the melts. The reference numeral 105 designates a furnace roof for closing the top of the spaces 106*b* and 106*c*. In the embodiment, the furnace roof is configured as a furnace cover which can close or open the upper opening of the furnace main unit 102. The furnace roof may be integrated with the furnace main unit into one body. The reference numeral 106 designates a space which is surrounded by the furnace bottom 103, the furnace side 104, and the furnace roof 105. The space 106 includes: a space 106*a* where melts or a base metal 151, and slug 152 floating thereon are to exist; the space 106*b*, above the space 106*a*, where wastes 153 are to exist; and the space 106*c*, above the space 106*b*, where gasses are to exist. The reference numeral 107 designates a waste inlet. Well-known waste charging means which is not shown and can maintain the gastightness of the space 106 is attached to the waste inlet. The reference numerals 108 and 109 designate a melt outlet, and a gas outlet, respectively. Well-known means which are used in the next step and can maintain the gastightness of the space 106, such as an apparatus for granulating melts, and a gas treatment apparatus are connected to these outlets, respectively. The embodiment in which the waste inlet 107 and the gas outlet 109 are disposed in the furnace roof 105 will be described. Alternatively, these may be formed in the furnace side. The embodiment in which the melt outlet 108 is formed in the furnace side will be described. Alternatively, the melt outlet may be formed in the furnace bottom. The reference numeral 110 designates electrodes for arc heating which function as heating means for melting wastes disposed in the furnace body 101. For example, three electrodes for a three-phase AC current are disposed and inserted through electrode openings 111 into the space 106. Alternatively, as the heating means, electrodes for supplying an electric current to the base metal 151 may be disposed in the space 106*a*, and an electric current is directly supplied from the electrodes to the base metal 151, thereby conducting resistance heating. As the heating means, induction heating means, or combustion heating means using a burner may be used.

Next, the furnace bottom 103 will be described. The reference numeral 114 designates a furnace bottom plate which is made of a metal material such as a steel plate. The lower face of the furnace bottom plate is supported by frame members which are not shown, so that a sufficient strength is attained. The reference numeral 115 designates a lining which covers the upper face of the furnace bottom plate 114 and protects the furnace bottom plate 114 from being worn by melts contacting therewith, and from being corroded by heat of the melts and gasses produced from wastes. The lining is configured by, for example, bricks of silicon carbide because of high resistance to contact with the melts. The thickness of the lining 115 is set to be a relatively small value which allows the erosion protection effect of the lining 115 due to the cooling which is conducted from the side of the lower face, to reach the upper face of the lining 115. Specifically, the thickness is selected so that the erosion protection effect which will be described later can be attained, or to, for example, be about 400 mm. The reference numeral 116 designates cooling means for cooling the lining 115 via the furnace bottom plate 114. The cooling means has a cooling ability by which the middle portion of the lining 115 in the thickness direction is cooled to a temperature lower than the solidification temperature of the melts on the lining. In the cooling means 116, 117 designates supply pipes for the coolant which are connected to the supply means for supplying the coolant such as chilled water. The reference numeral 118 designates branch pipes connected to the supply pipes 117. A number of spray means such as spray nozzles 119 for spraying the coolant on the lower face of the furnace bottom plate 114 are attached to the branch pipes 118. In an example, the spray nozzles 119 may be arranged so that the coolant is sprayed on the whole area of the lower face of the furnace bottom plate 114, thereby cooling the whole area. In another example, the coolant may be sprayed only on a partial area of the lower face (a portion of the furnace bottom plate 114 which is heated to a high temperature is preferably selected as the area to be sprayed), thereby directly cooling the area, and the other area is cooled by causing the sprayed coolant to flow on the surface of the other area. In order to reduce the downward projection from the lower face of the furnace bottom plate 114, the cooling means 116 is preferably embedded between the frame members for supporting the furnace bottom plate 114. Alternatively, air may be used as the coolant. In the alternative, a guide plate for air flow may be disposed so that air flow is produced on the area other than that on which the coolant is directly sprayed. The reference numeral 120 designates an outer cover for preventing the coolant ejected from the spray means from spattering. The ejected coolant is allowed to stay between the furnace bottom plate 114 and the outer cover 120, so that the chance of contacting the coolant with the furnace bottom plate 114 is increased, thereby improving the cooling efficiency. The reference numeral 121 designates a coolant outlet through which the coolant sprayed to the furnace bottom plate 114 and flowing down to the lower portion is discharged. The discharge may be conducted naturally, or forcedly by using a pump or the like.

Next, the furnace side 104 will be described. The reference numeral 124 designates a furnace side plate, 125 designates lining, 126 designates cooling means, 128 designates branch pipes, 129 designates spray means, 130 designates an outer cover, and 131 designates a coolant outlet. Among these components, the furnace side plate 124 is configured in function in the same or equivalent manner as the furnace bottom plate 114. The other components are configured in function in the same or equivalent manner as the components of the furnace bottom 103 which have the same name. In order to avoid duplication, their description is omitted. As the lining 125, bricks of magnesia or alumina are used because of high resistance to contact with melts or waste and also to an oxidizing atmosphere in the space 106*c*. The lining 125 may have a thickness of, about 200 mm. In the cooling means 126, pipes for supplying the coolant are not shown. In addition to the above-mentioned object, the outer cover 130 is disposed with the object of keeping dust out the furnace side plate 124 so that the efficiency of cooling by the spray means 129 is prevented from being impaired.

Next, the furnace roof 105 will be described. The reference numeral 134 designates a roof plate, 135 designates lining, 136 designates cooling means, 137 designates supply pipes for the coolant 138 designates branch pipes, 139 designates spray means, 140 designates an outer cover, and 141 designates a coolant outlet. Among these components, the roof plate 134 is configured in function in the same or equivalent manner as the furnace bottom plate 114. The other components are configured in function in the same or equivalent manner as the components of the furnace bottom 103 and the furnace side 104 which have the same name. In order to avoid duplication, their description is omitted. As the lining 135, a castable refractory which is high in alumina content is preferably used because of easy application on the lower face of the roof plate 134. The lining 135 may have a thickness of, about 200 mm.

All the furnace bottom plate 114, the furnace side plate 124, and the roof plate 134 are made of a steel plate, and the space 106 is hermetically closed by these plates.

The reference numeral 143 designates a water-cooled exhaust gas duct. The gas outlet 109 is connected through the duct 143 to the exhaust gas treatment apparatus. The reference numeral 144 designates the main unit of the duct 143 which is made of, for example, a steel plate. As required, the inner face of the body is covered by lining. The reference numeral 145 designates cooling means for the main unit 144, 146 designates branch pipes connected to a coolant supply pipe which is not shown, 147 designates a number of spray nozzles which are spray means attached to the branch pipes 146, and 148 designates a cover which covers the outside of the cooling means 145. These components are disposed with the same objects as those of the furnace bottom 103, etc. The reference numeral 149 designates electrodes for auxiliary heating which is used for, when melts are to be discharged, heating the melts in the melt outlet 108 to increase the flowability of the melts or to melt products solidified in the outlet.

In the thus configured waste melting furnace 101, the furnace diameter (the diameter in the case where the furnace has a circular shape in a plan view, and the horizontal sizes of the edges in the case where the furnace has a rectangular shape), and the furnace height are determined so as to obtain a predetermined capacity (the volume of the space 106).

The operation of the waste melting furnace will be described. As well known, the operation of the furnace is started by previously melting a small amount of the base metal 151 in the furnace. After the operation of the furnace is started, wastes 153 such as nonmetal wastes including burned residue of municipal refuse (burned ash), dust collection ash of municipal refuse, plastic wastes, and sewage are charged from the inlet 107 into the space **106*b* by the charging means. For example, this charging is continuously conducted. Alternatively, the charging may be intermittently conducted. In the alternative, a small amount of wastes may be charged in each charging operation in order to prevent the gas pressure in the furnace from being largely varied. The charged wastes 153 are heated by heat of arc generated by the electrodes 110, and also by heat transferred from the base metal 151 which is caused to be in a molten state by heat of the arc, and melt to reduce the volume. During the melting operation, for example, the space 106*c* is at a temperature of about 1,200° C., the slug 152 is at a temperature of about 1,300° to 1,350° C., and the base metal 151 is at a temperature of about 1,200° C. Most portion of the wastes 153 melts to be converted into the slug 152, and another part is converted into various kinds of gasses. The gasses move up together with dust into the space 106*c*. The gasses and dust which have moved up are discharged through the gas outlet 109 toward the treatment apparatus. The metal components of the molten wastes are sunk by their gravity to enter the base metal 151. As the wastes 153 which are sequentially charged melt so that the amount of the slug 152 is increased, and the slug 152 overflows to be gradually discharged through the outlet 108. The discharged slug is subjected to a solidifying process such as granulation. When the amount of the base metal 151 is increased and the metal is to be discharged, a metal discharge operation is conducted as follows. After the slug 152 is discharged, the furnace is tilted to, for example, the right side in FIG. 1 and the base metal 151 is discharged through the outlet 108**.

During the above-mentioned operation, in the furnace bottom 103, the furnace side 104, the furnace roof 105, and the exhaust gas duct 143, the coolant is supplied from the supply means to the respective spray means 119, 129, 139, and 147 through the supply pipe and the branch pipes, and the coolant is sprayed on the outer peripheral faces of the furnace bottom plate 114, the furnace side plate 124, and the roof plate 134, the exhaust gas duct 143, and the main unit 144, so that the components are cooled and also their inner linings 115, 125, and 135 are cooled via the components, thereby suppressing the erosion of the linings. The sprayed coolant flows down and is then discharged through the outlets 121, 131, and 141. In order to prevent corrosive gasses such as HCl, SOx, and NOx produced from the heated wastes from contacting with the plates to erode them, the cooling by the spray means is conducted so that the temperatures of the outer peripheral faces of the furnace bottom plate 114, the furnace side plate 124, the roof plate 134, and the main unit 144 are lowered to, for example, about 200° to 250° C.

During the operation, the space 106 in the furnace can hermetically be closed by the furnace bottom plate 114, the furnace side plate 124, and the roof plate 134. Even if harmful and corrosive gasses such as SOx, NOx, and HCl are produced when wastes are melted, therefore, such gasses are prevented from leaking to the outside. The linings 115, 125 and 135 protect the furnace bottom plate 114, the furnace side plate 124, the roof plate 134, etc. from being worn by melts contacting therewith, and from being corroded by gasses (for example, corrosive gasses such as above-mentioned HCl, and $H_2SO_4$) produced from wastes.

When the cooling by the spray means is conducted so that the temperatures of the surfaces of the furnace bottom plate 114, the furnace side plate 124, and the roof plate 134 are lowered to 100° C. or lower, for example, the corrosive gasses such as hydrochloric acid, and sulfuric acid are liquefied in the vicinity of the surfaces and their corrosiveness is increased to a very high level. In the cooling to 200° to 250° C., however, the temperatures of the surfaces are not lowered to their dew points. Even when the gasses pass through, for example, cracks of the linings to contact with the furnace bottom plate 114, the furnace side plate 124, the roof plate 134, etc., therefore, the resulting corrosion can be suppressed to a relatively low degree. Furthermore, since the cooling is conducted so as to cool the components to a relatively high temperature, the consumption of the coolant can be reduced to a relatively small amount.

In the waste melting furnace, the cooling due to chilled water is conducted by the spray system, and hence the furnace bottom plate 114, the furnace side plate 124, the roof plate 134, etc. are almost free from the water pressure during a process of water cooling. Even when these plates are partly damaged, therefore, the amount of water which leaks into the furnace through the breakage portion can be restricted to a minimal value, so that the danger of explosion due to water leakage can be lessened.

In the same manner as the furnace of FIG. 1, there exists the erosion protection effect of the linings 115, 125, and 135 due to the above-mentioned cooling in the furnace bottom 103, the furnace side 104, and the furnace roof 105. Even in the case where the linings 115, 125, and 135 have a relatively small thickness, therefore, the protection effect of the furnace bottom plate 114, the furnace side plate 124, and the roof plate 134 can be kept to be exhibited over the predetermined continuous operation period of the waste melting furnace.

During the operation of the waste melting furnace, because heavy metals such as copper, lead, and zinc contained in the melts such as the base metal 151 in the furnace have a low melting point, molten heavy metals may penetrate into joints and cracks of the lining 115 and flow downward. In the lining 115, however, although the portion contacting with the base metal 151 has a high temperature (for example, about 1,200° C.), the temperature is lowered as moving downward so that the middle portion has a temperature lower than the melting points of the metals.

Even when the molten metals penetrate as described above, however, they can be solidified in the middle portion of the lining 115 so that the metals are prevented from downward leaking from the lower portion of the furnace bottom 104. The cooling by the spray means 119 is preferably determined in accordance with metals which are expected to penetrate as described above, so that the middle portion of the lining 115 in the thickness direction is cooled to a temperature lower than the melting points of such metals.

In order to attain the objects that the thickness of the furnace roof 105 is reduced to lighten the furnace roof and the height of the furnace is reduced, that, even when the furnace roof is broken, the danger due to the breakage can be suppressed to a low level, and that the running cost required in such a case is suppressed to a low amount, the waste melting furnace may be configured in the following manner. That is, the spray means is disposed only in the furnace roof 105, no spray means is disposed in the furnace bottom 103 and the furnace side 104, and the linings 115 and 125 in the bottom and side have a large thickness which allows the linings to have a desired life period.

In order to attain the objects that the diameter of the furnace is reduced as compared with the capacity of the furnace, and that the running cost required in such a case is suppressed to a low amount, the waste melting furnace may be configured so that the spray means is disposed only in the furnace side 104, no spray means is disposed in the furnace bottom 103 and the furnace roof 105, and the linings 115 and 135 in the bottom and roof have a large thickness (in the furnace bottom, for example, 600 to 800 mm) which allows the linings to have a desired life period.

In order to attain the objects that the thickness of the furnace bottom 103 is reduced to decrease the height of the furnace, that, even when melts penetrate into joints and cracks of the lining of the furnace bottom 103, the melts are prevented from downward leaking from the lower portion of the furnace bottom, and that the running cost required in such a case is suppressed to a low amount, the waste melting furnace may be configured so that the spray means is disposed only in the furnace bottom 103, no spray means is disposed in the furnace side 104 and the furnace roof 105, and the linings 125 and 135 in the side and roof have a large thickness which allows the linings to have a desired life period.

Figure 3:
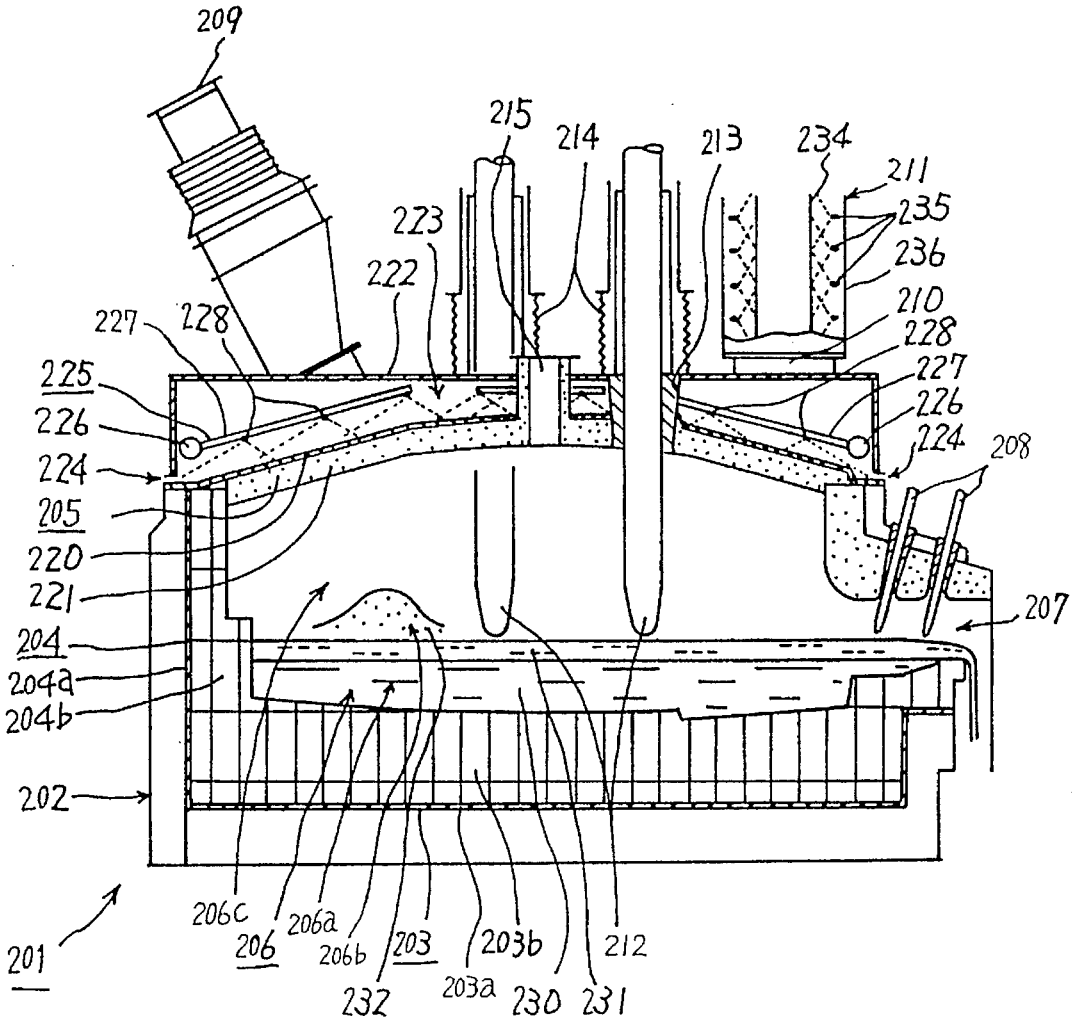
FIG. 3 is a longitudinal section view of a waste melting furnace which is different from the furnaces of FIGS. 1 and 2.

In a furnace of FIG. 3, 201 designates the body of a waste melting furnace, and 202 designates the furnace main unit of the furnace body 201 which is composed of a furnace bottom 203 for receiving melts 230 and 231, and a furnace side 204 for surrounding the melts placed on the furnace bottom 203 and the side peripheral of spaces 206*b* and 206*c* above the melts. The furnace bottom 203 and the furnace side 204 have a configuration which is well known in the field of a melting furnace of this type. For example, they are composed of a furnace bottom plate 203*a* and a furnace side plate 204*a* which are made of a steel plate, and linings 203*b* and 204*b* which respectively cover the upper face and the inner face. The reference numeral 205 designates a furnace roof for closing the top of the spaces 206*b* and 206*c*. In the embodiment, the furnace roof is configured as a furnace cover which can close or open the upper opening of the furnace main unit 202. The furnace roof 205 may be integrated with the furnace main unit 202 into one body. The reference numeral 206 designates a space which is surrounded by the furnace bottom 203, the furnace side 204, and the furnace roof 205. The space 206 includes: a space 206*a* where melts or a base metal 230, and slug 231 floating thereon are to exist; the space 206*b*, above the space 206*a*, where wastes 232 are to exist; and the space 206*c*, above the space 206*b*, where gasses are to exist.

The reference numeral 207 designates a melt outlet formed in the furnace side 204. Well-known means which is used in the next step and can maintain the gastightness of the space 206, such as an apparatus for granulating melts is connected to the outlet. The reference numeral 208 designates electrodes for auxiliary heating which is used for, when melts are to be discharged, heating the melts in the melt outlet 207 to increase the flowability of the melts or to melt products solidified in the outlet. The reference numerals 209 to 215 designate well-known components which are disposed in the furnace roof 205. Namely, 209 designates a waste inlet to which well-known waste charging means that is not shown and can maintain the gastightness of the space 206 is attached. The reference numeral 210 designates a gas outlet to which well-known means such as a gas treatment apparatus that is used in the next step and can maintain the gastightness of the space 206 is connected through a duct 211. The reference numeral 212 designates electrodes for arc heating which function as heating means for melting wastes disposed in the furnace body 201. For example, three electrodes for a three-phase AC current are disposed and inserted into the space 206 through electrode openings 213 formed in the furnace roof 205. The reference numeral 214 designates well-known bellows which can maintain the gastightness between the electrode openings and the electrodes. The reference numeral 215 designates a supplemental-material inlet. In addition to the above-mentioned-components, the furnace roof 205 is provided with many attachments such as a temperature measurement hole, and a sampling hole, and also with various parts associated with these attachments. As the heating means, electrodes for supplying an electric current to the base metal 230 may be disposed in the space 206*a*, and an electric current is directly supplied from the electrodes to the base metal 230, thereby conducting resistance heating. As the heating means, induction heating means, or combustion heating means using a burner may be used. The melt outlet 207 may be formed in the furnace bottom 203. Some of the waste inlet 209, the gas outlet 210, the temperature measurement hole, the sampling hole, and the various attachments may be disposed in the furnace side 204.

Next, the furnace roof 205 will be described. The reference numeral 220 designates a roof plate of the furnace roof 205. The roof plate is made of a metal material such as a steel plate. The upper face of the furnace roof plate is supported by frame members which are not shown, so that a sufficient strength is attained. The reference numeral 221 designates a lining which covers the lower face of the roof plate 220 and protects the roof plate 220 from being corroded by heat generated when wastes are melted in the furnace and by gasses produced from wastes. The lining is preferably configured by, for example, a castable refractory which is high in alumina content because of easy application on the lower face of the roof plate 220. The thickness of the lining 221 is set to be a relatively small value which allows the erosion protection effect of the lining 221 due to the cooling which is conducted from the side of the upper face, to reach the lower face of the lining 221. Specifically, the thickness is selected so that the erosion protection effect which will be described later can be attained, or to, for example, be about 200 mm.

The reference numeral 222 designates an upper board which is disposed above the furnace roof 205 via a space 223 for disposing the cooling means. The upper board 222 is a work board on which the worker mounts to perform works of inspecting and operating various members disposed on the furnace roof 205. In order to perform the works safely and efficiently, the board is placed so that the upper face elongates horizontally. The work board 222 has a diameter of, for example, about 5 m. The upper board 222 functions also as an outer cover for preventing the coolant ejected from cooling means which will be described later, from spattering. The upper board is disposed with the object of allowing the coolant ejected from the cooling means to stay between the roof plate 220 and the cover 222, so that the chance of contacting the coolant with the roof plate 220 is increased, thereby improving the cooling efficiency. In addition to the above-mentioned object, the cover 222 is disposed with the object of keeping dust out the upper face of the roof plate 220 so that the efficiency of cooling by the cooling means is prevented from being impaired. The upper board 222 is made of, for example, a steel plate, and attached to the frame members for supporting the roof plate 220. The height of the space 223 for disposing the cooling means is determined with considering conditions that it is sufficient for the coolant from the cooling means which will be described later to be sprayed on the whole area of the roof plate 220, and that it is sufficient for preventing heat of the roof plate 220 from being radiated to the work board 222. The reference numeral 224 designates a coolant outlet which is formed in the lowest portion of the roof plate 220. The discharge of the coolant through the outlet 224 may be conducted naturally, or forcedly by using a pump or the like.

The reference numeral 225 designates the cooling means for cooling the lining 221 via the roof plate 220 and blocking the heat radiation to the work board 222. In the cooling means 225, 226 designates supply pipes which are connected to the supply means for supplying the coolant such as chilled water. The reference numeral 227 designates branch pipes connected to the supply pipes 226. A number of spray means such as spray nozzles 228 for cooling the lining 221 via the roof plate 220 are attached to the branch pipes. The spray nozzles 228 are arranged so that the coolant is sprayed over the whole area of the roof plate 220 in order to cool the whole area of the roof plate 220 and also to block the heat radiation from the whole area of the roof plate 220 to the work board 222. In order to reduce the upward projection from the upper face of the roof plate 220, the cooling means 225 is preferably embedded between the frame members for supporting the roof plate 220. The furnace roof 205 is formed into a dome-like shape as illustrated, and the distance between the roof plate 220 and the upper board 222 is increased in the peripheral portion of the dome. In the portion, therefore, the spray nozzles 228 may be located at a higher position separated from the roof plate 220 or near the upper board 222 so that the coverage of each spray nozzle 228 or the area of the roof plate 220 on which the coolant can be sprayed is widened. As another example of the coolant, another fluid such as air may be used.

In the duct 211, 234 designates the body which is made of, for example, a steel plate. As required, the inner face of the body is covered by lining. The reference numeral 235 designates cooling means for the body 234. In the embodiment, the cooling means is configured as a number of spray nozzles which spray the coolant on the body 234 to cool it. The reference numeral 236 designates a cover which covers the out side of the cooling means 235 so that the coolant is prevented from spattering.

The operation of the waste melting furnace is conducted in a similar manner as that described in conjunction with the furnaces of FIGS. 1 and 2.

During the operation, in the furnace roof 205, the coolant is supplied from the supply means to the spray means 228 through the supply pipes 226 and the branch pipes 227, and the coolant is sprayed on the upper face of the roof plate 220 so that the roof plate 220 is cooled and also the lining 221 is cooled via the roof plate. This cooling prevents the lining 221 from being eroded. The reduced temperature of the roof plate 220 due to the cooling allows heat radiated from the roof plate 220 to the work board 222 to be kept to a small amount, thereby preventing the temperature of the work board 222 from being raised. The mist of the coolant sprayed on the roof plate 220 blocks the heat radiation from the roof plate 220 to the work board 222, whereby the temperature rise of the work board 222 is suppressed more effectively. As a result, the upper face of the work board 222 is kept to a low temperature at which the worker can work without hindrance (for example, about 30° C.). The coolant sprayed on the roof plate 220 flows down to the lower portion along the upper face of the roof plate 220, and is then discharged through the outlet 224. In order to prevent corrosive gasses such as HCl, SOx, and NOx produced from the heated wastes from being formed into an aqueous solution, the cooling is preferably conducted so that the temperature of the upper face of the roof plate 220 is lowered to, for example, about 200° to 250° C.

In the same manner as the furnace of FIG. 1, there exists the erosion protection effect of the lining 221 due to the above-mentioned cooling in the furnace roof 205. Even in the case where the lining 221 has a relatively small thickness, therefore, the protection effect of the furnace roof plate 220 can be kept to be exhibited over the predetermined long continuous operation period of the waste melting furnace.

In the waste melting furnace, works of inspecting and operating various members disposed on the furnace roof 205 can be performed under the state where the furnace is operated and the temperature of the furnace is high, because the work board 222 is kept to have a safety or low temperature. For assuring safety of the worker, however, it is preferable to perform the works under the state where the process of charging wastes through the inlet 209 and the power supply of the electrodes 212 are stopped.

Figure 4:
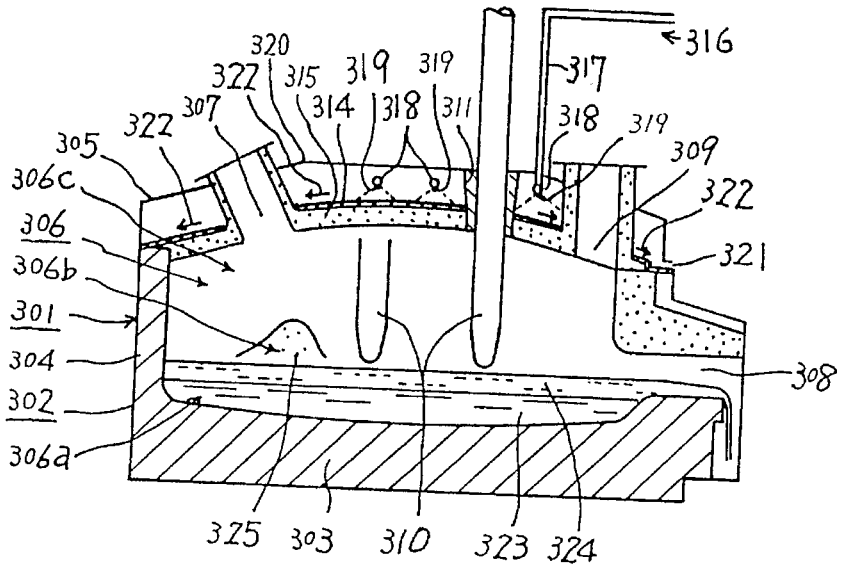
FIG. 4 is a longitudinal section view of a waste melting furnace which is different from the furnace of FIG. 3.
Figure 5:
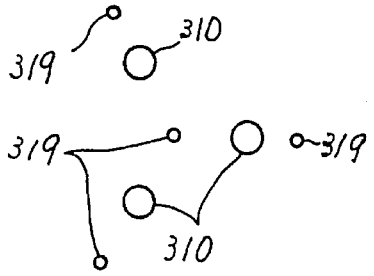
FIG. 5 is a plan view showing positional relationships between electrodes and nozzles in the furnace of FIG. 4.

In a furnace of FIG. 4, 301 designates the body of a waste melting furnace, and 302 designates the furnace main unit of the furnace body 301 which is composed of a furnace bottom 303 for receiving melts 323 and 324, and a furnace side 304 for surrounding the melts placed on the furnace bottom 303 and the side peripheral of spaces **306*b* and 306*c* above the melts. The furnace bottom 303 and the furnace side 304 have a configuration which is well known in the field of a melting furnace of this type. The reference numeral 305 designates a furnace roof for closing the top of the spaces 306*b* and 306*c*. In the embodiment, the furnace roof is configured as a furnace cover which can close or open the upper opening of the furnace main unit 302. The furnace roof may be integrated with the furnace main unit into one body. The reference numeral 306 designates a space which is surrounded by the furnace bottom 303, the furnace side 304, and the furnace roof 305. The space 306 includes: a space 306*a* where melts or a base metal 323, and slug 324 floating thereon are to exist; the space 306*b*, above the space 306*a*, where wastes 325 are to exist; and the space 306*c*, above the space 306*b*, where gasses are to exist. The reference numeral 307 designates a waste inlet. Well-known waste charging means which is not shown and can maintain the gastightness of the space 306 is attached to the waste inlet. The reference numerals 308 and 309 designate a melt outlet, and a gas outlet, respectively. Well-known means which are used in the next step and can maintain the gastightness of the space 306, such as an apparatus for granulating melts, and a gas treatment apparatus are connected to these outlets, respectively. The embodiment in which the waste inlet 307 and the gas outlet 309 are formed in the furnace roof 305 will be described. Alternatively, they may be formed in the furnace side. In the embodiment, the melt outlet 308 is formed in the furnace side. Alternatively, the outlet may be formed in the furnace bottom. The reference numeral 310 designates electrodes for arc heating which function as heating means for melting wastes disposed in the furnace body 301. For example, three electrodes for a three-phase AC current are disposed and inserted into the space 306 through electrode openings 311. As the heating means, electrodes for supplying an electric current to the base metal 323 may be disposed in the space 306***a*, and an electric current is directly supplied from the electrodes to the base metal 323, thereby conducting resistance heating. As the heating means, induction heating means, or combustion heating means using a burner may be used.

Next, the furnace roof 305 will be described. The reference numeral 314 designates a roof plate which is formed into a shape having a slope along which the coolant is to flow, for example, a hood-like shape having a center portion being highest, and which is made of a metal material such as a steel plate. The upper face of the furnace roof plate is supported by frame members which are not shown, so that a sufficient strength is attained. In order to allow the coolant to smoothly flow down, for example, the slope has an angle of about 15 deg. The reference numeral 315 designates a lining which covers the lower face of the roof plate 314 and protects the roof plate 314 from being corroded by heat generated when wastes are melted in the furnace and by gasses produced from wastes. The lining is preferably configured by of, for example, a castable refractory which is high in alumina content because of easy application on the lower face of the roof plate 314. The thickness of the lining 315 is set to be a relatively small value which allows the erosion protection effect of the lining 315 due to the cooling which is conducted from the side of the upper face, to reach the lower face of the lining 315. Specifically, the thickness is selected so that the erosion protection effect which will be described later can be attained, or to, for example, be about 200 mm. The reference numeral 316 designates the cooling means for cooling the lining 315 via the roof plate 314. In the cooling means 316, 317 designates a supply pipe which is connected to the supply means for supplying the coolant such as chilled water. The reference numeral 318 designates branch pipes connected to the supply pipe 317. A number of spray means such as spray nozzles 319 for cooling the lining 315 via the roof plate 314 are attached to the branch pipes. In order to spray the coolant on the upper face of a higher portion of the roof plate 314, the spray nozzles 319 are arranged above the center portion of the roof plate 314 which is the highest portion in the plate. In the embodiment, for example, the portion of the roof plate 314 which receives heat of the highest intensity is the portion in the periphery of the electrodes 310. In order to spray the coolant on that portion to effectively cool it, as shown in FIG. 2, the spray nozzles are disposed between and in the periphery of the electrodes 310. In order to reduce the upward projection from the upper face of the roof plate 314, the cooling means 316 is preferably embedded between the frame members for supporting the roof plate 314. Alternatively, air may be used as the coolant. In the alternative, a guide plate for air flow may be disposed so that air flow is produced on the area other than that on which the coolant is directly sprayed. The reference numeral 320 designates an outer cover for preventing the coolant ejected from the spray means from spattering. The ejected coolant is allowed to stay between the roof plate 314 and the outer cover 320, so that the chance of contacting the coolant with the roof plate 314 is increased, thereby improving the cooling efficiency. The outer cover 320 is disposed with the object of keeping dust out the upper face of the roof plate 314 so that the efficiency of cooling by the spray means 319 is prevented from being impaired. The reference numeral 321 designates a coolant outlet for discharging the coolant which has been sprayed on the roof plate 314 and then flows down along the roof plate 314. The discharge may be conducted naturally, or forcedly by using a pump or the like.

The operation of the waste melting furnace is conducted in a similar manner as that described in conjunction with the furnaces of FIGS. 1 and 2.

During the operation, in the furnace roof 305, the coolant is supplied from the supply means to the spray means 319 through the supply pipe 317 and the branch pipes 318, and the coolant is sprayed on the upper face of the higher portion of the roof plate 314. The sprayed coolant first cools the portion of the roof plate 220 and also the lining 315 via the roof plate. Then the sprayed coolant flows down over the roof plate 314 along the slope of the roof plate 314 as shown by arrow 322. During this procedure, the coolant cools the roof plate 314 in the flow-down path and also the lining 315 via the roof plate. In this way, the whole area of the lining is cooled by the process of spraying the coolant and the flow-down of the sprayed coolant, thereby preventing the lining 315 from being eroded. The coolant flows down to the lower portion as described above and is then discharged through the outlet 321. In order to prevent corrosive gasses such as HCl, SOx, and NOx produced from the heated wastes from being formed into an aqueous solution, the cooling by the spray means is preferably conducted so that the temperature of the upper face of the roof plate 314 is lowered to, for example, about 200° to 250° C.

During the operation, even if corrosive gasses such as HCl, and SOx are produced when wastes are melted, the lining 315 protects the roof plate 314 from corrosion due to these gasses.

When the cooling by the spray means is conducted so that, for example, the roof plate 314 is conducted to a temperature of 150° C. or lower, the corrosive gases are liquefied to become hydrochloric acid and sulfuric acid, thereby increasing their corrosiveness to a very high level. This is applicable also to the furnace of FIG. 3. In the above-mentioned cooling to 200° to 250° C., however, the gasses are not liquefied. Even when the gasses pass through, for example, cracks of the lining to reach the roof plate 314, therefore, the corrosion of the roof plate 314 can be suppressed to a relatively low degree. Furthermore, since the cooling is conducted so as to cool the components to a relatively high temperature, the consumption of the coolant can be reduced to a relatively small amount.

In the waste melting furnace, in the case where chilled water is used as the coolant, even when the furnace roof 305 is broken and the chilled water leaks into the furnace, a serious accident due to the leakage is prevented from occurring because the cooling is conducted by the spray means using a smaller amount of chilled water.

In the same manner as the furnace of FIG. 1, there exists the erosion protection effect of the lining 315 due to the above-mentioned cooling in the furnace roof 305. Even in the case where the lining 315 has a relatively small thickness, therefore, the protection effect of the furnace roof plate 314 can be kept to be exhibited over the predetermined long continuous operation period of the waste melting furnace.

Figure 6A:
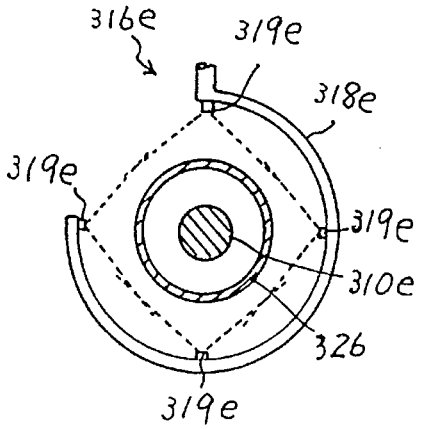
FIG. 6A is a plan view showing an embodiment in which cooling means is configured in a different manner.
Figure 6B:
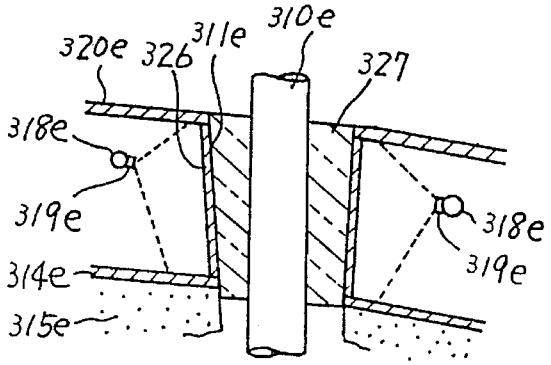
FIG. 6B is a longitudinal section view of the embodiment.

FIGS. 6A and 6B show another embodiment. In the embodiment, in order to spray the coolant on the upper face of a higher portion of a furnace roof plate 314*e*, spray means 319*e* disposed above the center portion of the roof plate 314*e* which is the highest portion in the plate is positioned so that the coolant is sprayed also on an enclosure wall 326 (made of a steel plate in the same manner as the roof plate 314*e*) surrounding electrode openings 311*e*, thereby effectively cooling it. The reference numeral 327 designates an electrode insulator. The components which are functionally identical with or equivalent to those in the previously described figures and the description of which may be duplicated are designated by the same reference numerals affixed by letter "e", and duplicated description is omitted. (Also in a furnace shown in the subsequent figures, similarly, such components are designated by the same reference numerals affixed by letter "f", and duplicated description is omitted.)

Figure 7:
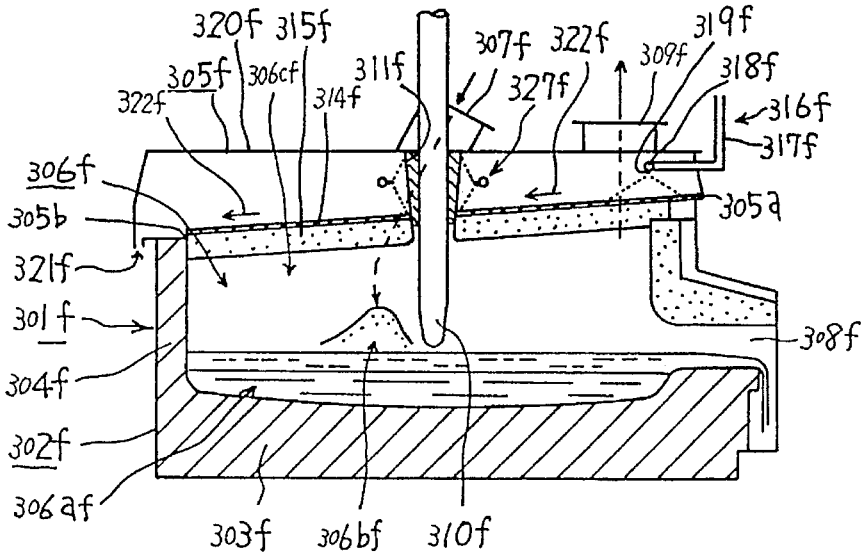
FIG. 7 is a longitudinal section view of a waste melting furnace which is different from the furnace of FIG. 4.
Figure 8:
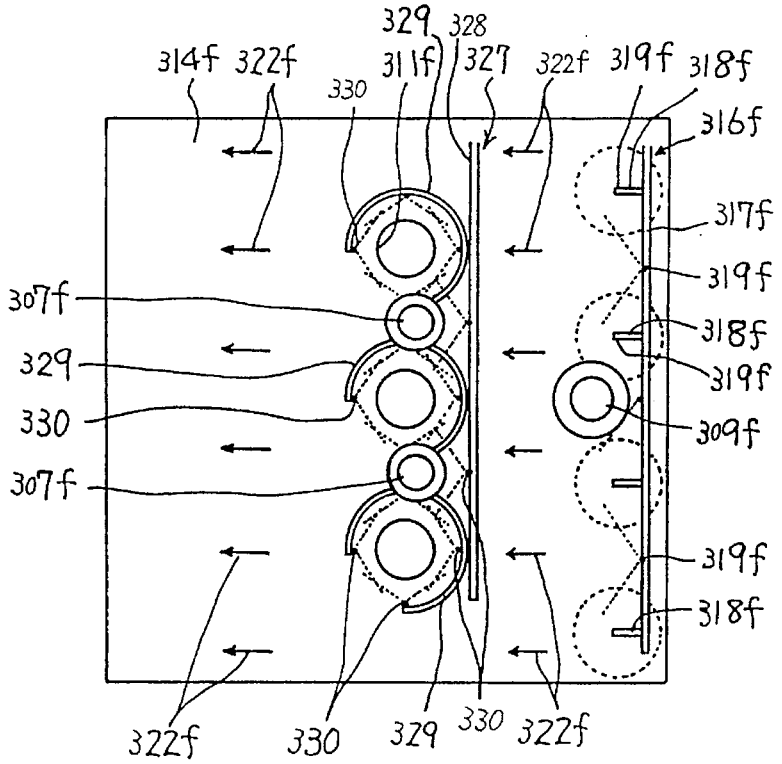
FIG. 8 is a plan view showing the arrangement of the cooling means in the embodiment of FIG. 7.

FIGS. 7 and 8 show a further embodiment of the invention. The furnace is formed so as to have a rectangular shape in a plan view. A furnace roof 305*f* is formed in such a manner that one side 305*a* of the roof is higher than the other side 305*b*. In order to spray the coolant on the highest portion of the upper face of the highest portion of the roof, spray means 319*f* is located at positions shown in the figures. The reference numeral 327 designates cooling means which is supplementally disposed in order to cool the portion which is in the vicinity of electrodes and receives heat of the highest intensity. The cooling means is equivalent in configuration to the cooling means 316. The reference numeral 328 designates a supply pipe for the coolant, 329 designates branch pipes, and 330 designates spray nozzles.

What is claimed is:

1. A waste melting furnace comprising a furnace body which surrounds melts, wastes to be placed on the melts, and a space above the melts and the wastes, a waste inlet, a melt outlet, and a gas outlet being disposed in said furnace body, heating means for heating the wastes being disposed in said furnace body so that wastes charged through said waste inlet are heated by the heating means and melted, wherein at least a portion of said furnace body is made of a metal material, an inner peripheral face of said metal material portion is covered by a lining for protecting said furnace body, said lining having a relatively small thickness which allows an erosion protection effect due to cooling which is conducted from a side of an outer face, to reach a side of an inner face, and spray means for spraying coolant on an outer peripheral face of said furnace body in order to cool said lining of said relatively thin portion, via said metal material portion is disposed outside said furnace body.

2. A waste melting furnace according to claim 1, wherein said portion of said furnace body is a roof of said furnace body, said roof is composed of a roof plate made of a metal, and a lining covering a lower face of said roof plate, said lining has a relatively small thickness which allows an erosion protection effect due to cooling which is conducted from a side of an upper face, to reach a side of a lower face, and spray means for spraying coolant on an upper face of said roof plate in order to cool said lining via said roof plate is disposed above said roof plate.

3. A waste melting furnace according to claim 1, wherein said portion of said furnace body is a side plate of said furnace body, said side plate is composed of a side plate made of a metal, and a lining covering an inner peripheral face of said side plate, said lining has a relatively small thickness which allows an erosion protection effect due to cooling which is conducted from a side of an outer face, to reach a side of an inner face, and spray means for spraying coolant on an outer face of said side plate in order to cool said lining via said side plate is disposed outside said side plate.

4. The waste melting furnace of claim 1 wherein said furnace body has a roof, a work board for a worker disposed above said roof of said furnace body, said board being separated from said roof by a space for disposing cooling means, and spray means for spraying coolant on an upper face of said furnace roof, thereby cooling said roof and blocking heat radiation from said roof to said work board disposed in said space for disposing cooling means.

5. The waste melting furnace of claim 1, said furnace further including a roof composed of a roof plate which is made of a metal and has a slope in order to allow coolant to flow down along an upper face, and a lining covering a lower face of said roof plate, said lining having a relatively small thickness which allows an erosion protection effect due to cooling which is conducted from a side of an upper face of said roof plate to reach a side of a lower face of said roof plate, and spray means for spraying the coolant on an upper face of a higher portion of said roof plate and allowing the sprayed coolant to flow down to a lower portion of said roof plate along the upper face of said roof plate, thereby cooling a substantially whole area of said lining via said roof plate disposed above said roof plate.

6. The waste melting furnace of claim 2 wherein said furnace body has a roof, a work board for a worker disposed above said roof of said furnace body, said board being separated from said roof by a space for disposing cooling means, and spray means for spraying coolant on an upper face of said furnace roof, thereby cooling said roof and blocking heat radiation from said roof to said work board disposed in said space for disposing cooling means.

7. The waste melting furnace of claim 2, said furnace further including a roof composed of a roof plate which is made of a metal and has a slope in order to allow coolant to flow down along an upper face, and a lining covering a lower face of said roof plate, said lining having a relatively small thickness which allows an erosion protection effect due to cooling which is conducted from a side of an upper face of said roof plate to reach a side of a lower face of said roof plate, and spray means for spraying the coolant on an upper face of a higher portion of said roof plate and allowing the sprayed coolant to flow down to a lower portion of said roof plate along the upper face of said roof plate, thereby cooling a substantially whole area of said lining via said roof plate disposed above said roof plate.

8. A waste melting furnace comprising a furnace body which surrounds melts, wastes to be placed on the melts, and a space above the melts and the wastes, a waste inlet, a melt outlet, and a gas outlet being disposed in said furnace body, heating means for heating the wastes being disposed in said furnace body so that wastes charged through said waste inlet are heated by the heating means and melted, wherein a bottom of said furnace body is composed of a furnace bottom plate made of a metal, and a lining covering an upper face of said furnace bottom plate, said lining has a relatively small thickness which allows an erosion protection effect due to cooling which is conducted from a side of a lower face, to reach a side of an upper face, and spray means for spraying coolant on a lower face of said furnace bottom plate in order to cool said lining via said furnace bottom plate so that a middle portion of said lining in a thickness direction has a temperature lower than a solidification temperature of the melts on said lining is disposed below said furnace bottom plate.

* * * * *